US011805575B2

(12) United States Patent
Acero Acero et al.

(10) Patent No.: US 11,805,575 B2
(45) Date of Patent: Oct. 31, 2023

(54) INDUCTION HOB DEVICE AND A METHOD FOR OPERATING AN INDUCTION HOB DEVICE

(71) Applicant: BSH Hausgeräte GmbH, Munich (DE)

(72) Inventors: Jesus Acero Acero, Saragossa (ES); Claudio Carretero Chamarro, Saragossa (ES); Sergio Llorente Gil, Saragossa (ES); Ignacio Lope Moratilla, Saragossa (ES); Daniel Palacios Tomas, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 722 days.

(21) Appl. No.: 16/061,361

(22) PCT Filed: Nov. 24, 2016

(86) PCT No.: PCT/IB2016/057106
§ 371 (c)(1),
(2) Date: Jun. 12, 2018

(87) PCT Pub. No.: WO2017/109610
PCT Pub. Date: Jun. 29, 2017

(65) Prior Publication Data

US 2018/0368214 A1 Dec. 20, 2018

(30) Foreign Application Priority Data

Dec. 23, 2015 (ES) ..... ES201531903

(51) Int. Cl.
*H05B 6/06* (2006.01)
*H05B 6/44* (2006.01)

(52) U.S. Cl.
CPC ..... *H05B 6/062* (2013.01); *H05B 6/44* (2013.01); *H05B 2213/03* (2013.01)

(58) Field of Classification Search
CPC .. H05B 2213/03; H05B 6/062; H05B 6/1245; H05B 6/065; H05B 6/1209; H05B 6/1272; H05B 1/0266; H05B 6/1236; H05B 6/1254; H05B 6/1263; H05B 6/44;
(Continued)

(56) References Cited

U.S. PATENT DOCUMENTS 6,144,019 A * 11/2000 Garcia ..... H05B 6/1281 219/624

FOREIGN PATENT DOCUMENTS

DE 102013214433 A1 3/2014
DE 102013214434 A1 3/2014
EP 1858300 A1 11/2007
(Continued)

OTHER PUBLICATIONS

English translation of EP1858300B1 (Year: 2011).*
(Continued)

*Primary Examiner* — Chris Q Liu
(74) *Attorney, Agent, or Firm* — Michael E. Tschupp; Brandon G. Braun; Andre Pallapies

(57) ABSTRACT

An induction hob device includes at least one cooktop, at least one first coil, at least one second coil, and a control unit. The first coil and the second coil are displaced relative to each other at least in a direction perpendicular to the cooktop. In order to improve an efficiency, the control unit is configured to at least temporarily operate the first coil and the second coil simultaneously.

15 Claims, 4 Drawing Sheets

(58) Field of Classification Search
CPC .. H05B 2206/022; H05B 6/1281; H05B 6/36; H05B 6/362
USPC .... 219/624, 622, 620, 621, 627, 462.1, 600, 219/671, 672, 675
See application file for complete search history.

(56) References Cited

FOREIGN PATENT DOCUMENTS

| | | | | |
|---|---|---|---|---|
| EP | 1858300 | B1 * | 5/2011 | ..... H05B 6/1245 |
| EP | 2945463 | A1 | 11/2015 | |
| GB | 2389767 | A | 12/2003 | |
| WO | 2010069883 | A1 | 6/2010 | |

OTHER PUBLICATIONS

English translation of DE 102013214434 (Year: 2014).*
International Search Report PCT/IB2016/057106 dated Feb. 7, 2017.
National Search Report ES 201531903 dated Dec. 19, 2016.

* cited by examiner

INDUCTION HOB DEVICE AND A METHOD FOR OPERATING AN INDUCTION HOB DEVICE

CROSS-REFERENCES TO RELATED APPLICATIONS

This application is the U.S. National Stage of International Application No. PCT/IB2016/057106, filed Nov. 24, 2016, which designated the United States and has been published as International Publication No. WO 2017/109610 A1 and which claims the priority of Spanish Patent Application, Serial No. P201531903, filed Dec. 23, 2015, pursuant to 35 U.S.C. 119(a)-(d).

BACKGROUND OF THE INVENTION

The invention relates to an induction hob device.

It is known to use induction hobs comprising at least one cooktop and several inductors which are located below the cooktop. Thereby, the inductors are located in-plane and distanced from each other.

Further, the document EP 1 858 300 A1 discloses an induction hob comprising a cooktop and several one-layer inductors which are displaced relative to each other at least in a direction perpendicular to the cooktop, wherein the inductors are operated alternately.

BRIEF SUMMARY OF THE INVENTION

The objective of the invention is, in particular, to provide a generic device with improved characteristics regarding an efficiency.

The invention relates to an induction hob device comprising at least one cooktop, at least one first coil and at least one second coil which are displaced relative to each other at least in a direction perpendicular to the cooktop and in particular at least when seen in a direction parallel to a main extension plane of the cooktop, and with a control unit.

It is proposed that the control unit is provided to at least temporarily operate the first coil and the second coil simultaneously. "Provided" is to be understood in particular as specifically programmed, designed and/or equipped. By an object being provided for a certain function, it is in particular to be understood that the object fulfills and/or implements this certain function in at least one application state and/or operating state. A "main extension plane" of an object, is to be understood, in particular, as a plane which is parallel to a largest side and/or face of a smallest, in particular imagined, in particular geometric, cuboid, which encloses the object just completely and preferably intersects a center, in particular a geometric center, of the cuboid.

An "induction hob device" is to be understood, in particular, at least as a part, in particular a subassembly, of an induction hob. Moreover, the induction hob device may, in particular, also comprise the entire induction hob. Preferably, the induction hob device comprises a plurality of coils and/or inductors, in particular at least four, preferably at least six, advantageously at least twelve, more advantageously at least twenty-four and most advantageously at least forty-eight coils and/or inductors. Hence, the induction hob device preferably is formed as a matrix-hob device and/or a flexible hob device.

In this context, a "coil" is to be understood, in particular, as an inductive element, which preferably is formed by at least one wire, in particular heating wire, and which advantageously is part of an inductor. The coil, in particular, comprises at least one winding and preferably several windings like at least two, at least five, at least ten and/or at least fifteen windings, in particular located in one layer and/or preferably in several layers. Advantageously, the coil is provided to generate an alternating electromagnetic field, which is converted into heat in a bottom of a cooking utensil by means of eddy currents and/or magnetization and demagnetization effects. Particularly advantageously, the first coil and the second coil comprise a same diameter and are preferably at least substantially identical. In this context, a "diameter" of an object is supposed to refer, in particular, to a diameter of a smallest, in particular imagined, circuit, which encloses the object just completely. The term "at least substantially identical" is to be understood, in particular, as identical apart from manufacturing tolerances and/or within the limits of standardized tolerances and/or within the limits of manufacturing possibilities.

Moreover, a "control unit", in particular, is to be understood to mean an electrical and/or electronical unit, which is provided to control and/or regulate an operation of the induction hob and/or at least of a subassembly of the induction hob. For this purpose, the control unit preferably comprises a processor unit, a memory unit and/or an operating program which is advantageously stored in the memory unit and preferably executed by the processor unit. In addition, the induction hob device may, in particular, comprise at least one power supply unit, which is in particular provided to supply at least one of the coils with energy, and/or at least one retainer unit, which in particular comprises at least one retainer element which is, in particular, provided to retain and/or support at least one of the coils. In particular, the retainer element can be formed as an arbitrary retainer element like a retainer plate, in particular a printed circuit board and/or a printed circuit board-substrate, and/or a, in particular specifically constructed, holder. By the implementation according to the invention, an induction hob device can be obtained, in particular having improved characteristics regarding an efficiency, in particular a power efficiency, an installation space efficiency, a component efficiency and/or a cost efficiency. Additionally, a flexibility can be advantageously increased. Thereby, in particular an improved distribution and/or arrangement of the coils may be obtained, which, in particular, leads to a particularly uniform power distribution by which an advantageous thermal distribution in the bottom of a cooking utensil may be achieved. In addition, in particular an improved coverage resolution, in particular with respect to a cooking utensil placed on the cooktop, may be obtained by which, in particular, a flexibility can be further increased.

Preferably, the first coil and the second coil are substantially displaced relative to each other at least in a direction parallel to the cooktop and/or at least when seen in a direction perpendicular to the main extension plane of the cooktop. By the expression that an object is "substantially displaced" with respect to a further object at least in a direction parallel to the cooktop, it is to be understood, in particular, that at most 85%, advantageously at most 80% and more advantageously at most 75% of all lines, which emanate from the object and are perpendicular to the main extension plane of the cooktop, intersect the further object. Preferably, the second coil is arranged with respect to the first coil in such a way that a center, in particular a geometric center, of the second coil is distanced from an outer border of the first coil at least when seen in the direction perpendicular to the main extension plane of the cooktop. By that, in particular a distribution and/or an arrangement of the coils can be optimized.

Further, it is proposed that the first coil and the second coil at least partly overlap at least in a direction perpendicular to the cooktop and/or at least when seen in the direction perpendicular to the main extension plane of the cooktop. Particularly advantageously, an overlapping area between the first coil and the second coil amounts to at least 5%, preferably at least 10% and more preferably at least 15%, and at most 45%, preferably at most 40% and more preferably at most 35%, of a total surface area of the first coil or the second coil at least when seen in the direction perpendicular to the main extension plane of the cooktop. By that, in particular a distance between centers of the coils can be reduced and/or a diameter of the inductor can be increased, in particular by a factor 1.77, while a distance between the centers can be kept constant.

Moreover, it is proposed that the first coil and the second coil are located directly adjacent relative to each other. By the expression that two coils are "directly adjacent", it is to be understood, in particular, that no other coil is located between the two coils. As a result, in particular, a particularly compact induction hob device may be obtained.

In accordance with the invention, it is proposed that the first coil and the second coil are electrically connected, in particular in parallel and/or in series and preferably by means of an electrical wire and/or a via, in particular in case of using printed circuit board retainer elements. By this, in particular a control algorithm may be advantageously simplified.

In one preferred embodiment of the invention, it is proposed that the induction hob device comprises at least one third coil which is displaced relative to the first coil and the second coil at least in a direction perpendicular to the cooktop and in particular at least when seen in the direction parallel to the main extension plane of the cooktop, wherein the control unit is provided to at least temporarily operate the third coil simultaneously with the first coil and the second coil. Advantageously, the third coil and the first coil and/or the third coil and the second coil comprise a same diameter and are preferably at least substantially identical. Particularly advantageously, the third coil is located directly adjacent to the first coil and/or the second coil. As a result, in particular, a coverage resolution may be further increased, by which a particularly uniform power distribution may be achieved.

Further, it is proposed that the third coil is substantially displaced relative to the first coil and/or the second coil at least in a direction parallel to the cooktop and/or at least when seen in the direction perpendicular to the main extension plane of the cooktop. Preferably, the third coil is arranged with respect to the first coil and the second coil in such a way that a center, in particular a geometric center, of the third coil is distanced from an outer border of the first coil and the second coil at least when seen in the direction perpendicular to the main extension plane of the cooktop. Hereby, in particular a distribution and/or an arrangement of the coils may be further optimized.

A particularly compact induction hob device may in particular be obtained, if the third coil and the first coil and/or the third coil and the second coil at least partly overlap at least in a direction perpendicular to the cooktop and/or at least when seen in the direction perpendicular to the main extension plane of the cooktop. Advantageously, an overlapping area between the third coil and the first coil amounts to at least 5%, preferably at least 10% and more preferably at least 15%, and at most 45%, preferably at most 40% and more preferably at most 35%, of a total surface area of the third coil or the first coil at least when seen in the direction perpendicular to the main extension plane of the cooktop. In addition, preferably an overlapping area between the third coil and the second coil amounts to at least 5%, preferably at least 10% and more preferably at least 15%, and at most 45%, preferably at most 40% and more preferably at most 35%, of a total surface area of the third coil or the second coil at least when seen in the direction perpendicular to the main extension plane of the cooktop.

Additionally, it is proposed that the third coil and the first coil and/or the third coil and the second coil are electrically connected, in particular in parallel and/or in series and preferably by means of an electrical wire and/or a via, in particular in case of using printed circuit board retainer elements, by which in particular a control algorithm may be advantageously simplified. Thereby, the first coil, the second coil and the third coil are advantageously electrically connected, in particular in parallel and/or in series and preferably by means of an electrical wire and/or a via, in particular in case of using printed circuit board retainer elements.

In one embodiment, it is proposed that the first coil and the second coil at least partly, preferably at least largely and more preferably completely, form an, in particular exactly one, inductor. Particularly advantageously, the first coil, the second coil and the third coil at least partly, preferably at least largely and more preferably completely, form an, in particular exactly one, inductor. The term "at least largely" is to be understood, in particular, as at least 55%, advantageously at least 65%, preferably at least 75%, more preferably at least 85% and particularly advantageously at least 95%. By that, in particular a simple construction may be obtained.

A particularly uniform heat distribution and/or thermal distribution may, in particular, be obtained, if the induction hob device comprises at least one further inductor which is at least substantially identical to the inductor, wherein the inductors comprise an at least substantially equal effective distance to the cooktop. In this context, an "effective distance to the cooktop", is to be understood, in particular, as a distance which corresponds to an arithmetic mean of distances, which is in particular obtained by adding up the distances of all coils of one inductor to the cooktop and dividing the result by the number of coils. Moreover, by an "at least substantially equal effective distance", it is to be understood, in particular, that an effective distance of an inductor differs from an effective distance of a further inductor by at most 10%, preferably at most 7.5% and more preferably at most 5%.

Moreover, it is proposed that the inductors interleave each other, in particular at least when seen in the direction perpendicular to the main extension plane of the cooktop. By the expression that "an object interleaves a further object at least when seen in the direction perpendicular to a main extension plane of the cooktop", it is to be understood, in particular, that at least one line exists which is perpendicular to the main extension plane of the cooktop and intersects the object and the further object, in particular at least when seen in the direction perpendicular to the main extension plane of the cooktop. As a result, a particularly compact and/or flexible induction hob device can be obtained.

Further, the invention relates to a method for operating an induction hob device, wherein the induction hob device comprises at least one cooktop, at least one first coil and at least one second coil which are displaced relative to each other at least in a direction perpendicular to the cooktop and in particular at least when seen in a direction parallel to a main extension plane of the cooktop.

It is proposed that the first coil and the second coil are at least temporarily operated simultaneously. By that, in particular, an efficiency, in particular a power efficiency, an installation space efficiency, a component efficiency and/or a cost efficiency, and/or a flexibility can be advantageously increased. Moreover, in particular an improved distribution and/or arrangement of the coils may be obtained, which, in particular, leads to a particularly uniform power distribution by which an advantageous thermal distribution in the bottom of a cooking utensil may be achieved.

The induction hob device is herein not limited to the application and to the implementation described above. In particular, for the purpose of fulfilling a functionality herein described, the induction hob device can comprise a number of respective elements, structural components and units that differ from the number mentioned herein.

Further advantages of the invention may be derived from the description of the figures below. The figures show four exemplary embodiments of the invention. The figures, the description and the claims contain numerous features in combination. The features may also be considered individually, and may be combined into useful further combinations.

BRIEF DESCRIPTION OF THE DRAWINGS

It is shown in.

DETAILED DESCRIPTION OF EXEMPLARY EMBODIMENTS OF THE PRESENT INVENTION

Figure 1:
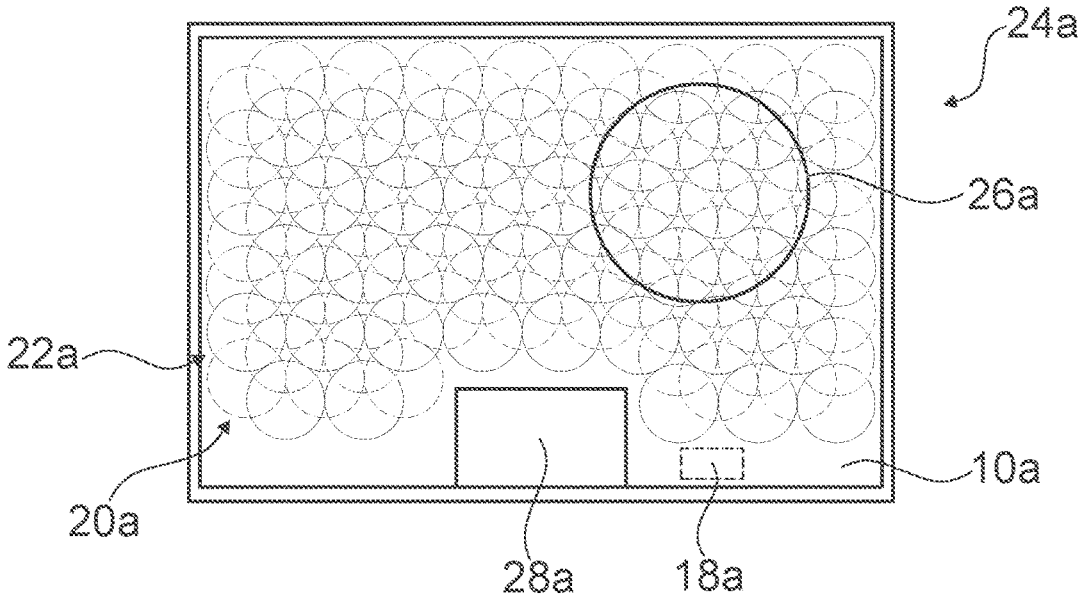
FIG. 1 a simplified schematic top view of an induction hob comprising an induction hob device having a cooktop and several inductors, FIG. 2 an enlarged view of the inductors, FIG. 3 a simplified schematic top view of one inductor of the inductors, FIG. 4 a simplified schematic side view of the inductor, FIG. 5 a simplified schematic side view of the inductor and an at least substantially identical further inductor of the inductors, FIG. 6 a simplified schematic side view of an inductor of a further induction hob device, FIG. 7 a simplified schematic side view of the inductor of FIG. 6 and an at least substantially identical further inductor, FIG. 8 a simplified schematic top view of the inductors of FIG. 7, FIG. 9 a simplified schematic side view of an inductor of a further induction hob device and FIG. 10 a simplified perspective view of an inductor of a further induction hob device.

FIG. 1 shows a top view of an exemplary induction hob 24*a*. In the present case, the induction hob 24*a* is formed as a matrix-hob and/or a flexible hob. The induction hob 24*a* comprises an induction hob device. The induction hob device comprises a cooktop 10*a*. The cooktop 10*a* is adjustable and comprises flexible and/or changeable heating zones. The cooktop 10*a* and/or heating zones are provided to heat at least one cooking utensil 26*a*.

The induction hob device further comprises an operating interface 28*a*. The operating interface 28*a* is provided for controlling an operation of the induction hob 24*a* and/or the induction hob device, in particular by entering and/or choosing at least one parameter like a heating power, a heating density, a heating stage and/or a heating zone.

Moreover, the induction hob device comprises a control unit 18*a*. The control unit 18*a* comprises a processor unit, a memory unit and an operating program which is stored in the memory unit and executed by the processor unit. The control unit 18*a* is provided for controlling a cooking process.

Figure 2:
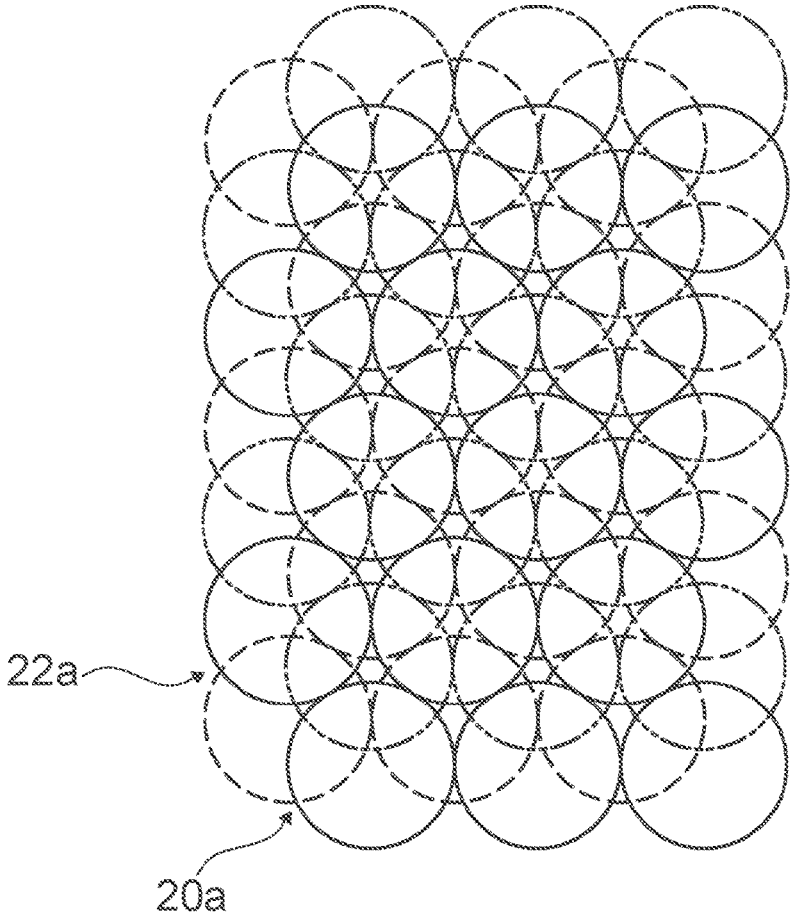

The induction hob device further comprises at least one inductor 20*a*, 22*a*. In the present case, the induction hob device comprises a plurality of inductors 20*a*, 22*a*, here in particular between 12 and 48 inductors 20*a*, 22*a*, wherein for simplicity, in particular, in FIGS. 1 and 2 merely two of the inductors 20*a*, 22*a* are provided with reference numbers. The inductors 20*a*, 22*a* are located below the cooktop 10*a*. The inductors 20*a*, 22*a* correspond to heating units. The inductors 20*a*, 22*a* are at least substantially identical. The inductors 20*a*, 22*a* are arranged in such a way that the inductors 20*a*, 22*a* comprise an equal effective distance to the cooktop 10*a*. The inductors 20*a*, 22*a* are provided to create the, in particular flexible, heating zones. The inductors 20*a*, 22*a* are provided for generating an alternating electromagnetic field, which is converted into heat in a bottom of the cooking utensil 26*a* by means of eddy currents and/or magnetization and demagnetization effects. As an alternative, it is conceivable that an induction hob device comprises two, four and/or six, in particular non-flexible, heating zones and/or two, four and/or six inductors, wherein each inductor is assigned to one of the heating zones.

Figure 3:
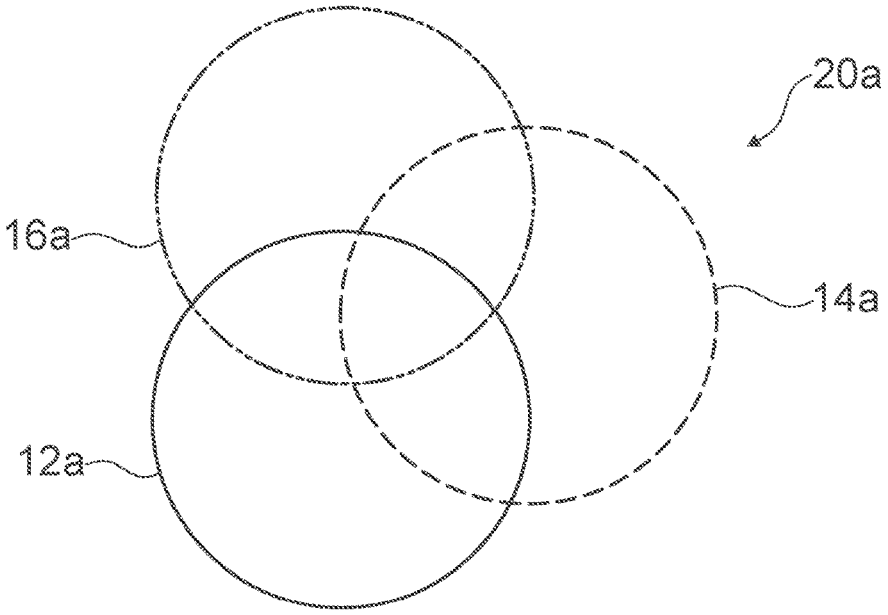
Figure 4:
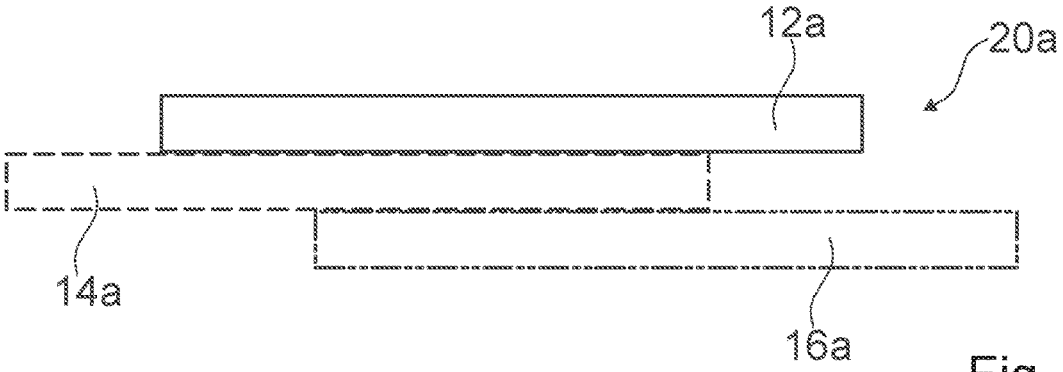

In the following with respect to FIGS. 3 and 4 merely one inductor 20*a* of the inductors 20*a*, 22*a* is described in more detail. Thereby, the following description can also be applied to the further inductors 22*a* of the inductors 20*a*, 22*a*, in particular due to the at least substantially identical construction of the inductors 20*a*, 22*a*.

The inductor 20*a* comprises a first coil 12*a*. The first coil 12*a* is formed as a spiral coil. The first coil 12*a* is at least substantially circular at least when seen in a direction perpendicular to a main extension plane of the cooktop 10*a*. The first coil 12*a* comprises fifteen windings in one layer. The first coil 12*a* is located directly adjacent to the cooktop 10*a*. As an alternative, it is conceivable that a first coil comprises an arbitrary other number of windings and/or layers. Thereby, a first coil might be formed as a solenoid and/or an elliptic coil. Moreover, the inductor 20*a* comprises a second coil 14*a*. The second coil 14*a* is formed as a spiral coil. The second coil 14*a* is at least substantially circular at least when seen in the direction perpendicular to the main extension plane of the cooktop 10*a*. The second coil 14*a* comprises fifteen windings in one layer. The second coil 14*a* is at least substantially identical to the first coil 12*a*. The second coil 14*a* is displaced relative to the first coil 12*a* at least in a direction perpendicular to the cooktop 10*a*. The second coil 14*a* is located below the first coil 12*a* in particular with respect to the cooktop 10*a*. Thereby, the second coil 14*a* is located directly adjacent to the first coil 12*a*, in particular at least when seen in the direction perpendicular and parallel to the main extension plane of the cooktop 10*a*.

Moreover, the second coil 14*a* is substantially displaced relative to the first coil 12*a* at least in a direction parallel to the cooktop 10*a*. The second coil 14*a* is thereby arranged with respect to the first coil 12*a* in such a way that a geometric center of the second coil 14*a* is distanced from an outer border of the first coil 12*a* at least when seen in the direction perpendicular to the main extension plane of the cooktop 10*a*. Furthermore, the first coil 12*a* and the second coil 14*a* at least partly overlap at least when seen in the direction perpendicular to the main extension plane of the cooktop 10*a*. In the present case, an overlapping area between the first coil 12*a* and the second coil 14*a* amounts to about 30% of a total surface area of the first coil 12*a* or the second coil 14*a* at least when seen in the direction perpendicular to the main extension plane of the cooktop 10*a*.

In the present case, the first coil 12*a* and the second coil 14*a* are additionally electrically connected. Thereby, the first coil 12*a* and the second coil 14*a* are connected in series. As an alternative, it is conceivable that a first coil and a second coil are connected in parallel or are not connected. Thereby, it is also conceivable that a second coil is part of another inductor. Moreover, it is conceivable that a second coil comprises an arbitrary other number of windings and/or layers. Furthermore, a second coil might be formed as a solenoid and/or an elliptic coil. Additionally, it is conceivable that a second coil is flipped and/or mirrored relative to a first coil, in particular with respect to a plane which is parallel to a main extension plane of a cooktop.

Moreover, the inductor 20*a* comprises a third coil 16*a*. The third coil 16*a* is formed as a spiral coil. The third coil 16*a* is at least substantially circular at least when seen in the direction perpendicular to the main extension plane of the cooktop 10*a*. The third coil 16*a* comprises fifteen windings in one layer. The third coil 16*a* is at least substantially identical to the first coil 12*a* and the second coil 14*a*. The third coil 16*a* is displaced relative to the first coil 12*a* at least in a direction perpendicular to the cooktop 10*a*. In addition, the third coil 16*a* is displaced relative to the second coil 14*a* at least in a direction perpendicular to the cooktop 10*a*. The third coil 16*a* is located below the first coil 12*a* in particular with respect to the cooktop 10*a*. Moreover, the third coil 16*a* is located below the second coil 14*a* in particular with respect to the cooktop 10*a*. Thereby, the third coil 16*a* is located directly adjacent to the second coil 14*a*, in particular at least when seen in the direction perpendicular and parallel to the main extension plane of the cooktop 10*a*.

Moreover, the third coil 16*a* is substantially displaced relative to the first coil 12*a* at least in a direction parallel to the cooktop 10*a*. The third coil 16*a* is thereby arranged with respect to the first coil 12*a* in such a way that a geometric center of the third coil 16*a* is distanced from an outer border of the first coil 12*a* at least when seen in the direction perpendicular to the main extension plane of the cooktop 10*a*. In addition, the third coil 16*a* is substantially displaced relative to the second coil 14*a* at least in a direction parallel to the cooktop 10*a*. The third coil 16*a* is thereby arranged with respect to the second coil 14*a* in such a way that a geometric center of the third coil 16*a* is distanced from an outer border of the second coil 14*a* at least when seen in the direction perpendicular to the main extension plane of the cooktop 10*a*.

Furthermore, the first coil 12*a* and the third coil 16*a* at least partly overlap at least when seen in the direction perpendicular to the main extension plane of the cooktop 10*a*. In the present case, an overlapping area between the first coil 12*a* and the third coil 16*a* amounts to about 30% of a total surface area of the first coil 12*a* or the third coil 16*a* at least when seen in the direction perpendicular to the main extension plane of the cooktop 10*a*. In addition, the second coil 14*a* and the third coil 16*a* at least partly overlap at least when seen in the direction perpendicular to the main extension plane of the cooktop 10*a*. In the present case, an overlapping area between the second coil 14*a* and the third coil 16*a* amounts to about 30% of a total surface area of the second coil 14*a* or the third coil 16*a* at least when seen in the direction perpendicular to the main extension plane of the cooktop 10*a*.

Besides, the first coil 12*a*, the second coil 14*a* and the third coil 16*a* are electrically connected. Thereby, the first coil 12*a*, the second coil 14*a* and the third coil 16*a* are connected in series and in particular form the inductor 20*a*. As an alternative, it is conceivable that a first coil and a third coil and/or a second coil and a third coil are connected in parallel or are not connected. Thereby, it is also conceivable that a third coil is part of another inductor. Moreover, it is conceivable that a third coil comprises an arbitrary other number of windings and/or layers. Furthermore, a third coil might be formed as a solenoid and/or an elliptic coil. Additionally, it is conceivable that a third coil is flipped and/or mirrored relative to a first coil or a second coil, in particular with respect to a plane which is parallel to a main extension plane of a cooktop. Besides, it is also conceivable to refrain from using a third coil, so that an inductor is formed merely by a first coil and a second coil.

The control unit 18*a* is provided for controlling a cooking process by regulating a heating output of the inductor 20*a* and/or the inductors 20*a*, 22*a*, in particular by activating a power supply (not shown). Consequently, the control unit 18*a* is provided to operate the first coil 12*a*, the second coil 14*a* and the third coil 16*a* simultaneously. As a result, a uniform thermal distribution in the cooking utensil 26*a* can be achieved, wherein an effective diameter of the inductor 20*a* can be increased while keeping a distance between centers of the coils 12*a*, 14*a*, 16*a* constant. As an alternative, it is conceivable to supply coils with different power supplies of a power supply unit. Moreover, at least for the purpose of improving an efficiency of the induction hob 24*a*, the control unit 18*a* is provided to merely operate the inductors 20*a*, 22*a* which are located at least partly below the cooking utensil 26*a*.

Figure 5:
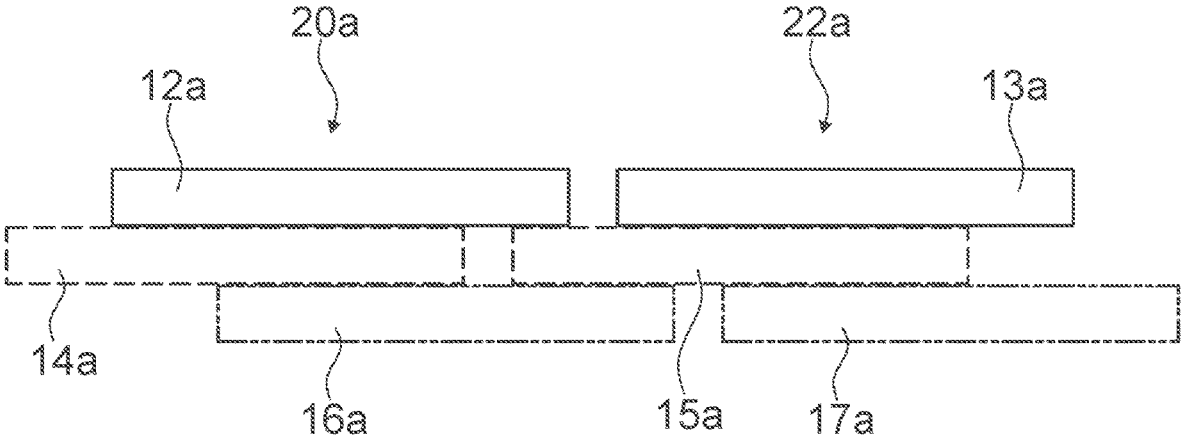

FIG. 5 shows the inductor 20*a* and an at least substantially identical further inductor 22*a* of the inductors 20*a*, 22*a*. The further inductor 22*a* is directly adjacent to the inductor 20*a* at least when seen in the direction perpendicular and parallel to the main extension plane of the cooktop 10*a*. The inductor 20*a* and the further inductor 22*a* are arranged in such a way that the inductor 20*a* and the further inductor 22*a* comprise an equal effective distance to the cooktop 10*a*, which in particular results in a particularly uniform heat distribution and/or thermal distribution, in particular in the cooking utensil 26*a*. In the present case, the effective distance to the cooktop 10*a* is between 3 mm and 15 mm.

Moreover, the inductor 20*a* and the further inductor 22*a* are arranged in such a way that the inductor 20*a* and the further inductor 22*a* interleave each other. Thereby, a further second coil 15*a* of the further inductor 22*a*, which is in particular located between a further first coil 13*a* of the further inductor 22*a* and a further third coil 17*a* of the further inductor 22*a* and is in particular equal to the second coil 14*a*, is at least partly located between the first coil 12*a* and the third coil 16*a* at least when seen in the direction perpendicular and/or parallel to the main extension plane of the cooktop 10*a*. Hence, at least one line exists which is perpendicular to the main extension plane of the cooktop 10*a* and intersects the inductor 20*a* and the further inductor 22*a* at least when seen in the direction perpendicular to the cooktop 10*a*. By overlapping the inductors 20*a*, 22*a* a coverage resolution and by that in particular a flexibility of the induction hob 24*a* can be advantageously improved which leads to a particularly uniform power distribution. In the present case, the inductors 20*a*, 22*a* are moreover supplied using the same power supply. As an alternative, it is also conceivable to supply different inductors, in particular directly adjacent inductors, using different power supplies and/or different phases of a power supply by which advantageously magnetic interferences and/or magnetic disturbances can be effectively reduced.

The FIGS. 6 to 10 show further exemplary embodiments of the invention. The description below and the figures are at least substantially limited to the differences between the exemplary embodiments. Regarding components that are designated in the same way, particularly regarding components having identical reference numerals, reference can be made to the figures and/or the description of the other exemplary embodiment, especially of FIGS. 1 to 5. In order to differentiate the exemplary embodiments, the letter a is added after the reference numerals of the exemplary embodiment in FIGS. 1 to 5. In the exemplary embodiments of FIGS. 6 to 10, the letter a is replaced by the letters b to d.

Figure 6:
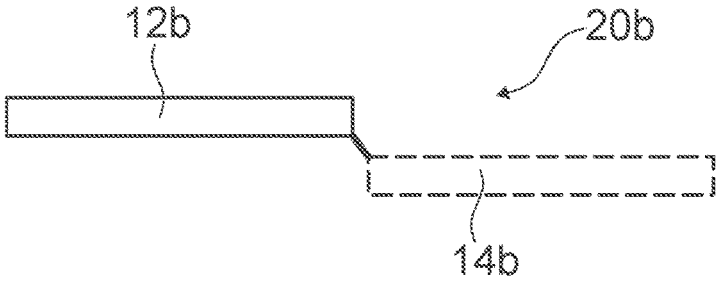
Figure 7:
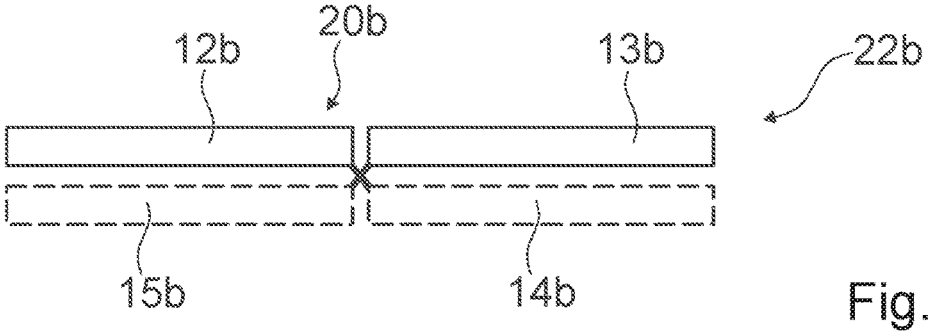
Figure 8:
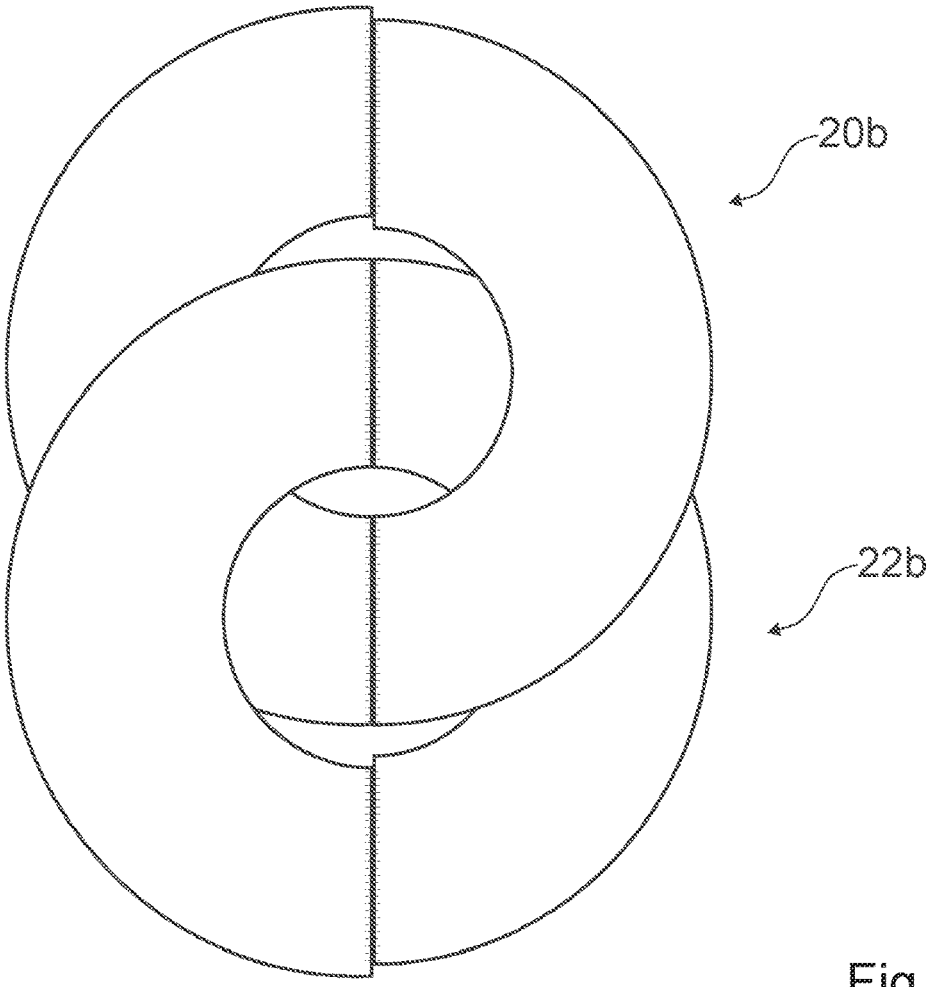

The FIGS. 6 to 8 show one further embodiment of the invention. The letter b is postposed to the reference numbers of the further embodiment of the FIGS. 6 to 8. The further embodiment of the FIGS. 6 to 8 differs from the previous embodiment at least substantially by a construction of inductors 20*b*, 22*b* of an induction hob device.

In the present case each inductor 20*b*, 22*b* comprises exactly two coils 12*b*, 13*b*, 14*b*, 15*b*. A first coil 12*b*, a second coil 14*b*, a further first coil 13*b* and a further second coil 15*b* are at least substantially semicircular at least when seen in a direction perpendicular to a main extension plane of a cooktop 10*b*. Thereby, the first coil 12*b* and the second coil 14*b* are distanced from each other at least when seen in the direction perpendicular to the main extension plane of the cooktop 10*b*. Hence, the first coil 12*b* and the second coil 14*b* do not overlap. Moreover, the further first coil 13*b* and the further second coil 15*b* are distanced from each other at least when seen in the direction perpendicular to the main extension plane of the cooktop 10*b*. Hence, the further first coil 13*b* and the further second coil 15*b* do not overlap.

Thereby, the inductor 20*b* and the further inductor 22*b* are mirror-symmetrically, in particular with respect to a plane which is perpendicular to the main extension plane of the cooktop 10*b*.

As it can be seen from FIG. 8, the inductor 20*b* and the further inductor 22*b* comprise an at least substantially interdigitated shape.

Figure 9:
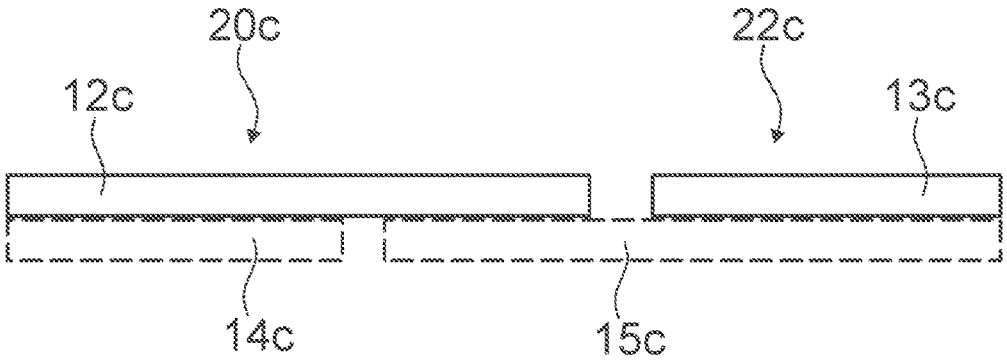

FIG. 9 shows one further embodiment of the invention. The letter c is postposed to the reference numbers of the further embodiment of FIG. 9. The further embodiment of FIG. 9 differs from the previous embodiments at least substantially by a construction of inductors 20*c*, 22*c* of an induction hob device.

In the present case each inductor 20*c*, 22*c* comprises exactly two coils 12*c*, 13*c*, 14*c*, 15*c*. A first coil 12*c* and a further second coil 15*c* are at least substantially identical. Thereby, the first coil 12*c* and the further second coil 15*c* are at least substantially circular at least when seen in a direction perpendicular to a main extension plane of a cooktop 10*c*. Moreover, a second coil 14*c* and a further first coil 13*c* are at least substantially identical. The second coil 14*c* and the further first coil 13*c* are at least substantially semicircular at least when seen in a direction perpendicular to a main extension plane of a cooktop 10*c*.

In addition, the second coil 14*c* is arranged in such a way that the first coil 12*c* completely covers the second coil 14*c* at least when seen in the direction perpendicular to the main extension plane of the cooktop 10*c*. Moreover, the further second coil 15*c* is arranged in such a way that the further first coil 13*c* at least partly covers the further second coil 15*c* at least when seen in the direction perpendicular to the main extension plane of the cooktop 10*c*.

Thereby, the inductor 20*c* and the further inductor 22*c* are rotationally symmetric, in particular with respect to a plane which is parallel to the main extension plane of the cooktop 10*c*.

The first coil 12*c* and the further second coil 15*c* thereby at least partly overlap at least when seen in the direction perpendicular to the main extension plane of the cooktop 10*c*. In the present case, an overlapping area between the first coil 12*c* and the further second coil 15*c* amounts to about 30% of a total surface area of the first coil 12*c* or the further second coil 15*c* at least when seen in the direction perpendicular to the main extension plane of the cooktop 10*c*.

Figure 10:
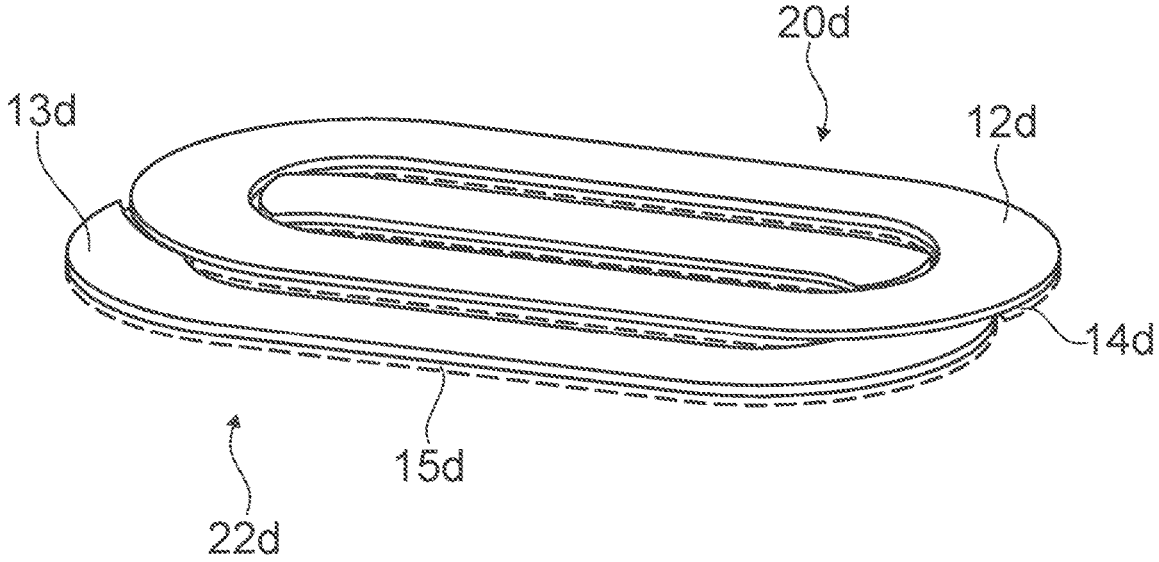

FIG. 10 shows one further embodiment of the invention. The letter d is postposed to the reference numbers of the further embodiment of FIG. 10. The further embodiment of FIG. 10 differs from the previous embodiments at least substantially by a construction of inductors 20*d*, 22*d* of an induction hob device.

In the present case, the inductors 20*d*, 22*d* are embodied as vector coils. Thereby, at least a first coil 12*d*, a second coil 14*d*, a further first coil 13*d* and a further second coil 15*d* are at least partly oval and/or elliptic at least when seen in a direction perpendicular to a main extension plane of a cooktop 10*d*.

The invention claimed is:

1. An induction hob device, comprising:

a cooktop having a main extension plane;

a first coil and a second coil disposed below the cooktop, the first coil being displaced relative to the second coil at least in a direction perpendicular to the main extension plane of the cooktop; and a control unit configured to at least temporarily operate the first and second coils simultaneously, wherein, when an outermost border of the first coil is offset from an outermost border of the second coil in the direction perpendicular to the main extension plane of the cooktop such that the first and second coils only partially overlap each other.

2. The induction hob device of claim 1, wherein the first and second coils are located directly adjacent relative to each other.

3. The induction hob device of claim 1, wherein the first and second coils are electrically connected.

4. The induction hob device of claim 1, further comprising a third coil which is displaced relative to the first and second coils at least in the direction perpendicular to the main extension plane of the cooktop, said control unit being configured to at least temporarily operate the third coil simultaneously with the first and second coils.

5. The induction hob device of claim 4, wherein, when the first and second coils are viewed from above the cooktop in the direction perpendicular to the main extension plane of the cooktop, an outermost border of the third coil is offset from at least one of the outermost borders of the first and second coils.

6. The induction hob device of claim 4, wherein the third coil and at least one of the first and second coils are electrically connected.

7. The induction hob device of claim 1, wherein the first and second coils at least partly form an inductor.

8. The induction hob device of claim 7, further comprising a further inductor which is substantially identical to the inductor, wherein the inductor and the further inductor comprise an at least substantially equal effective distance to the cooktop.

9. The induction hob device of claim 8, wherein the inductor and the further inductor interleave each other.

10. The induction hob device of claim 1, wherein the first and second coils are located directly adjacent relative to each other in the direction perpendicular to the main extension plane of the cooktop and not spaced apart in the direction perpendicular to the main extension plane of the cooktop.

11. The induction hob device of claim 1, wherein the first coil includes at least one winding and the second coil includes at least one winding, and wherein, when the first and second coils are viewed from above the cooktop in the direction perpendicular to the main extension plane of the cooktop, an outermost border of the at least one winding of the first coil is offset from an outermost border of the at least one winding of the second coil.

12. The induction hob device of claim 1, wherein the first coil includes a plurality of windings and the second coil includes a plurality of windings, and wherein, when the first and second coils are viewed from above the cooktop in the direction perpendicular to the main extension plane of the cooktop, an outermost border of the plurality of windings of the first coil is offset from an outermost border of the plurality of windings of the second coil.

13. The induction hob device of claim 1, wherein the first and second coils only partly overlap each other when viewed in the direction perpendicular to the main extension plane of the cooktop, and an overlapping area between the first coil and the second coil is at least one of equal to and less than 45% of a total surface area of one of the first and second coils.

14. The induction hob device of claim 1, wherein the first and second coils only partly overlap each other when viewed in the direction perpendicular to the main extension plane of the cooktop, and an overlapping area between the first coil and the second coil is substantially 30% of a total surface area of one of the first and second coils.

15. An induction hob, comprising an induction hob device, said induction hob device comprising a cooktop having a main extension plane, a first coil and a second coil disposed below the cooktop, the first coil being displaced relative to the second coil at least in a direction perpendicular to the main extension plane of the cooktop, and a control unit configured to at least temporarily operate the first and second coils simultaneously, wherein, when an outermost border of the first coil is offset from an outermost border of the second coil in the direction perpendicular to the main extension plane of the cooktop such that the first and second coil partially overlap each other.

* * * * *